US011177600B2

(12) United States Patent
Wang et al.

(10) Patent No.: US 11,177,600 B2
(45) Date of Patent: Nov. 16, 2021

(54) RECEPTACLE CONNECTOR AND METHOD OF PLUGGING PLUG CONNECTOR

(71) Applicant: Tyco Electronics (Shanghai) Co. Ltd., Shanghai (CN)

(72) Inventors: Hao Wang, Shanghai (CN); Jianfei Yu, Shanghai (CN); Biao Pan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 48 days.

(21) Appl. No.: 16/741,025

(22) Filed: Jan. 13, 2020

(65) Prior Publication Data

US 2020/0153143 A1 May 14, 2020

Related U.S. Application Data

(63) Continuation of application No. PCT/EP2018/068162, filed on Jul. 5, 2018.

(30) Foreign Application Priority Data

Jul. 13, 2017 (CN) ..... 201710569707.8

(51) Int. Cl.
*H01R 13/11* (2006.01)
*H01R 13/187* (2006.01)
*H01R 4/50* (2006.01)

(52) U.S. Cl.
CPC ..... *H01R 13/187* (2013.01); *H01R 4/5008* (2013.01)

(58) Field of Classification Search
CPC .... H01R 13/187; H01R 4/5008; H01R 43/26; H01R 13/193; H01R 13/111; H01R 13/10
(Continued)

(56) References Cited

U.S. PATENT DOCUMENTS 8,414,339 B1 * 4/2013 Glick ..... H01R 13/187 439/843
9,325,095 B2 * 4/2016 Glick ..... B60L 53/16
(Continued)

FOREIGN PATENT DOCUMENTS

DE 102008058203 A1 5/2010
DE 102011111581 A1 2/2013
WO 2017102534 A1 6/2017

OTHER PUBLICATIONS

PCT Notification, International Search Report and The Written Opinion of the International Searching Authority, Intl App No. PCT/EP2018/068162, dated Aug. 24, 2018, 14 pages.
(Continued)

*Primary Examiner* — Abdullah A Riyami
*Assistant Examiner* — Nelson R. Burgos-Guntin
(74) *Attorney, Agent, or Firm* — Barley Snyder

(57) ABSTRACT

A receptacle connector includes a first cylinder, a second cylinder, and a plurality of elongated conductors. Each of the elongated conductors has a first end located in and connected to the first cylinder and a second end located in and connected to the second cylinder. The elongated conductors are arranged in a circular shape and are spaced apart from each other. The elongated conductors define an inner space into which a plug is inserted. The first cylinder is rotatable relative to the second cylinder. The elongated conductors clasp and electrically contact the plug in the inner space when the elongated conductors are twisted and deformed by rotation of the first cylinder relative to the second cylinder.

20 Claims, 8 Drawing Sheets

(58) Field of Classification Search
USPC ..... 439/851
See application file for complete search history.

(56) References Cited

U.S. PATENT DOCUMENTS

| | | | | |
|---|---|---|---|---|
| 9,601,856 | B2 * | 3/2017 | Regantini | H01R 13/11 |
| 9,711,299 | B2 * | 7/2017 | Cortinovis | H01H 9/02 |
| 2003/0077950 | A1 * | 4/2003 | Swearingen | H01R 4/4881 439/843 |
| 2004/0003498 | A1 * | 1/2004 | Swearingen | H01R 13/187 29/862 |
| 2009/0197482 | A1 * | 8/2009 | Mark | H01R 43/16 439/852 |
| 2010/0140225 | A1 * | 6/2010 | Seo | H01H 33/664 218/140 |
| 2011/0144732 | A1 * | 6/2011 | Hill | A61N 1/0573 607/119 |
| 2012/0129374 | A1 * | 5/2012 | Tu | H01H 1/385 439/312 |
| 2013/0109237 | A1 * | 5/2013 | Glick | H01R 13/187 439/625 |
| 2016/0172770 | A1 | 6/2016 | Ando | |
| 2017/0338606 | A1 * | 11/2017 | Copper | H01R 43/20 |
| 2020/0153143 | A1 * | 5/2020 | Wang | H01R 13/187 |
| 2021/0104843 | A1 * | 4/2021 | Tobey | H01R 13/112 |

OTHER PUBLICATIONS

Abstract of DE 10 2011 111 581, dated Feb. 21, 2013, 1 page.
Abstract of DE 10 2008 058 203, dated May 20, 2010, 1 page.

* cited by examiner

RECEPTACLE CONNECTOR AND METHOD OF PLUGGING PLUG CONNECTOR

CROSS-REFERENCE TO RELATED APPLICATIONS

This application is a continuation of PCT International Application No. PCT/EP2018/068162, filed on Jul. 5, 2018, which claims priority under 35 U.S.C. § 119 to Chinese Patent Application No. 201710569707.8, filed on Jul. 13, 2017.

FIELD OF THE INVENTION

The present invention relates to an electrical connector and, more particularly, to a receptacle connector.

BACKGROUND

A receptacle connector generally comprises an insulation housing and at least one contact provided in the insulation housing. An insertion chamber is defined in the insulation housing. A plug of a plug connector mated with the receptacle connector is inserted into the insertion chamber of the receptacle connector and electrically contacts the contact in the receptacle connector.

The contact generally comprises a fixation portion and an elastic arm connected to the fixation portion. The fixation portion of the contact is fixed to the insulation housing. A protruding contact point is formed on an end of the elastic arm. The manufacture of such contact is very time-consuming and costly, increasing the cost of the connector.

In addition, in the prior art, in order to ensure reliable electrical contact between the plug of the plug connector and the contact of the receptacle connector, it is necessary to generate a large elastic contact force between the contact of the receptacle connector and the plug of the plug connector, which will increase a force for inserting or pulling the plug connector into or out of the receptacle connector, and increase the difficulty in inserting or pulling the plug connector. Moreover, during inserting or pulling, serious wear occurs on the contact and plug, which shortens the service life of the connector.

SUMMARY

A receptacle connector includes a first cylinder, a second cylinder, and a plurality of elongated conductors. Each of the elongated conductors has a first end located in and connected to the first cylinder and a second end located in and connected to the second cylinder. The elongated conductors are arranged in a circular shape and are spaced apart from each other. The elongated conductors define an inner space into which a plug is inserted. The first cylinder is rotatable relative to the second cylinder. The elongated conductors clasp and electrically contact the plug in the inner space when the elongated conductors are twisted and deformed by rotation of the first cylinder relative to the second cylinder.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
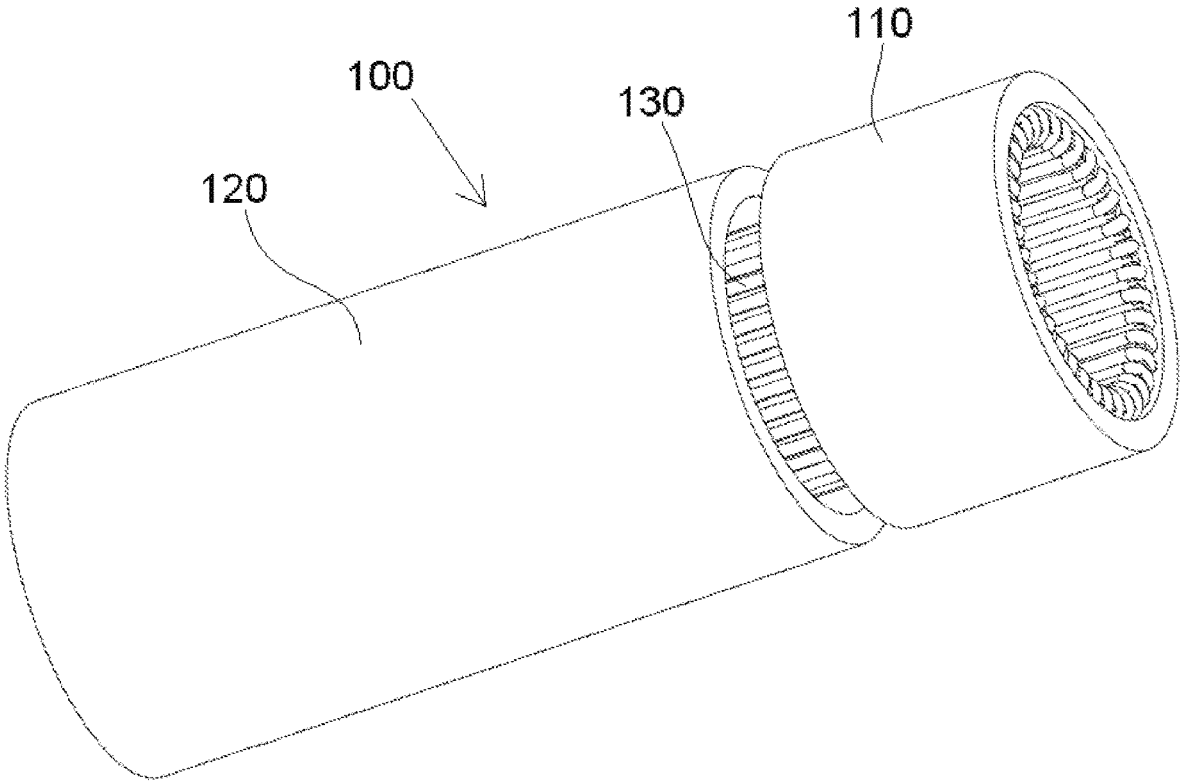
FIG. 1 is a perspective view of a receptacle connector according to an embodiment.
Figure 2:
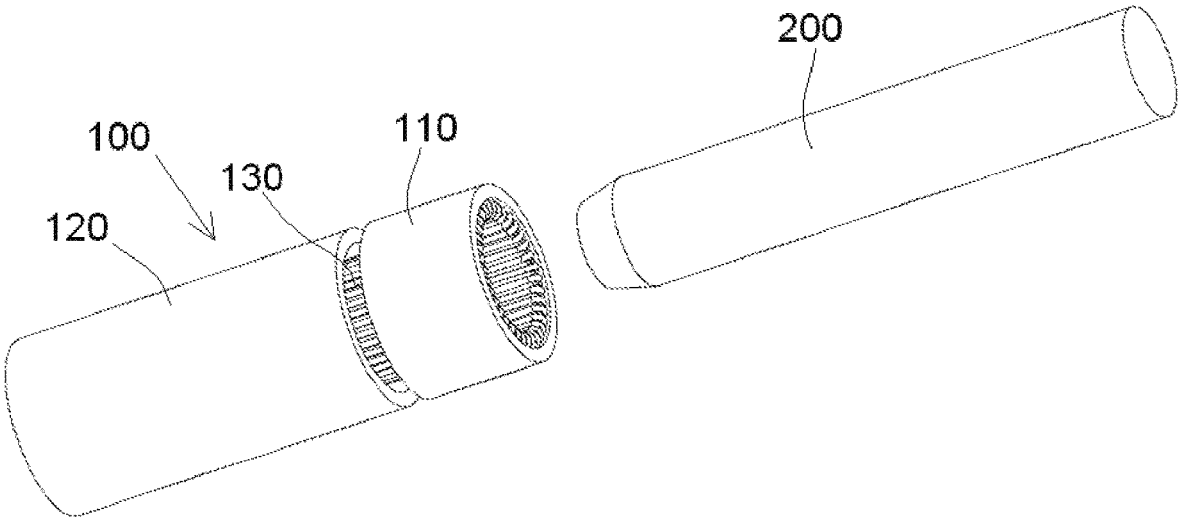
FIG. 2 is a perspective view of the receptacle connector and a plug connector prior to insertion of the plug connector into the receptacle connector.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A receptacle connector according to an embodiment, as shown in FIG. 1, comprises a first cylinder 110, a second cylinder 120, and a plurality of elongated conductors 130. A first end of each of the elongated conductors 130 is located in and connected to the first cylinder 110, and a second end of each of the elongated conductors 130 opposite to the first end is located in and connected to the second cylinder 120.

Figure 8:
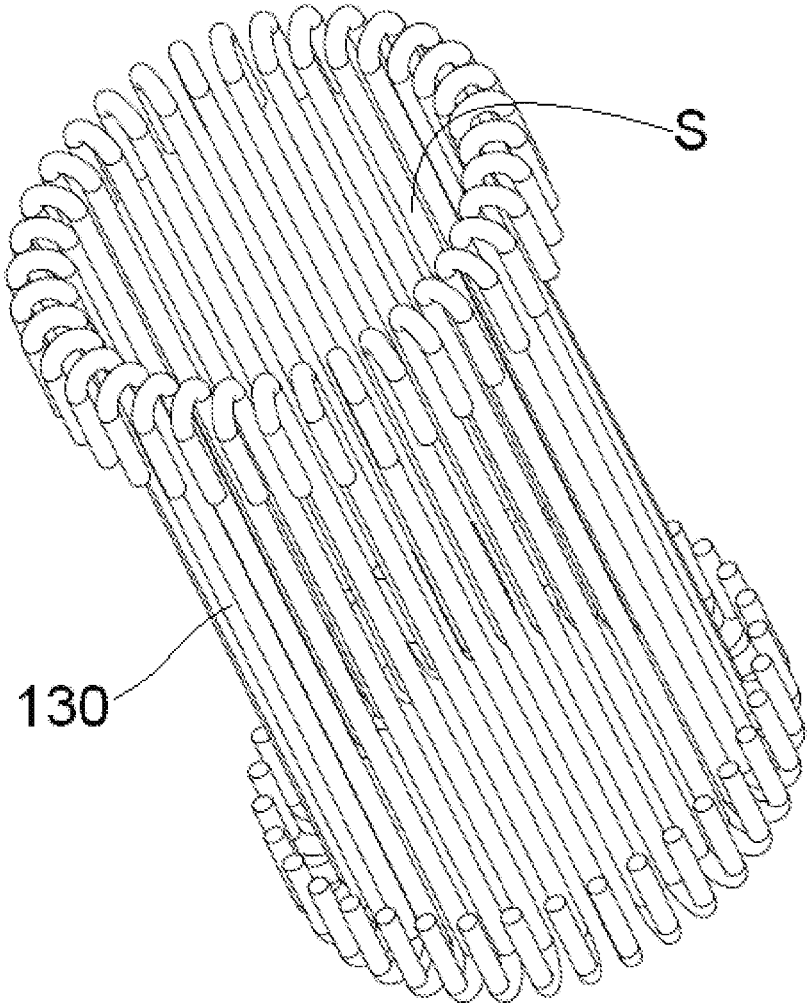
FIG. 8 is a perspective view of the elongated conductors in an initial state in which the elongated conductors are not twisted and deformed.
Figure 9:
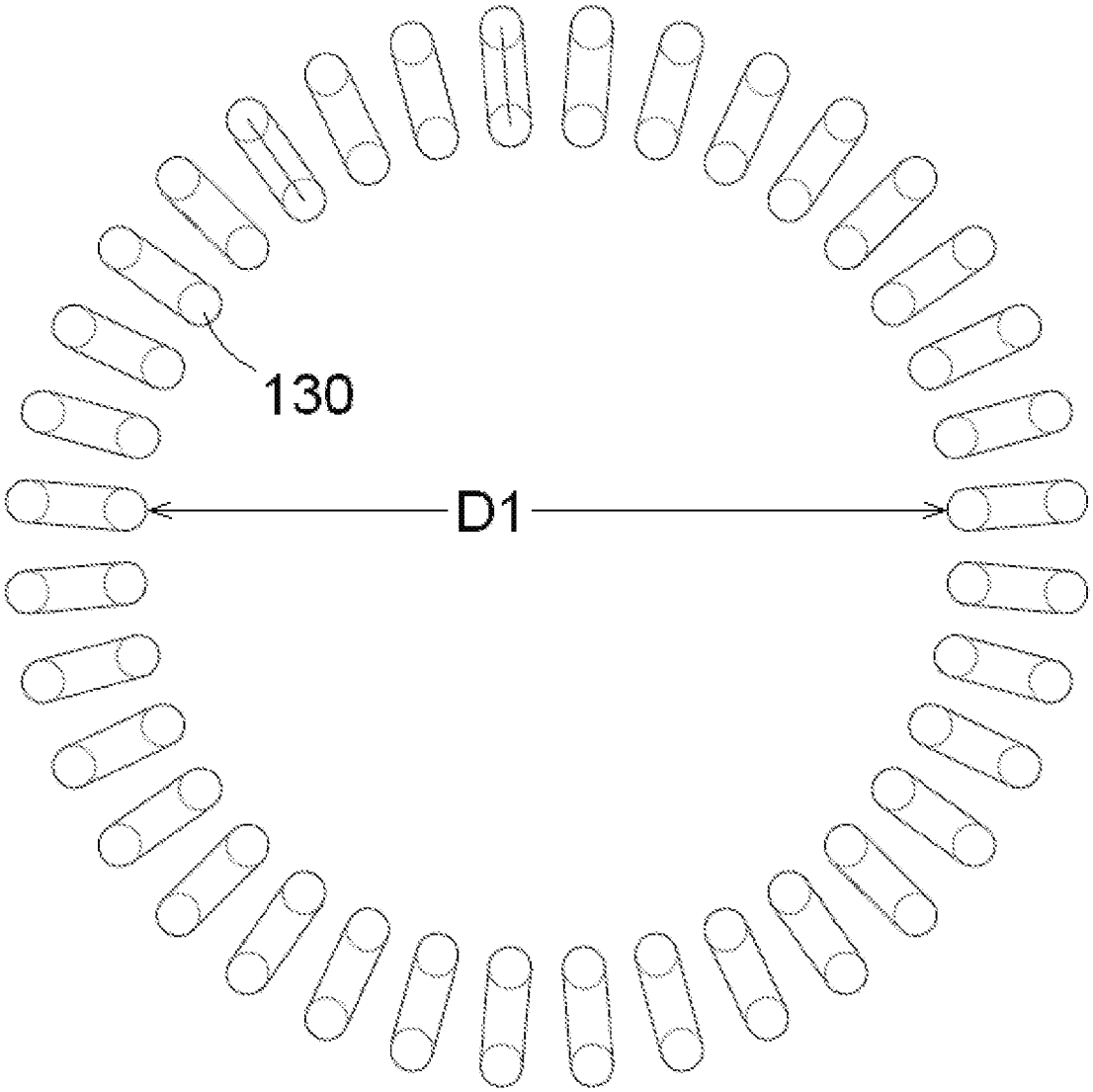
FIG. 9 is a plan view of the elongated conductors in the initial state.
Figure 10:
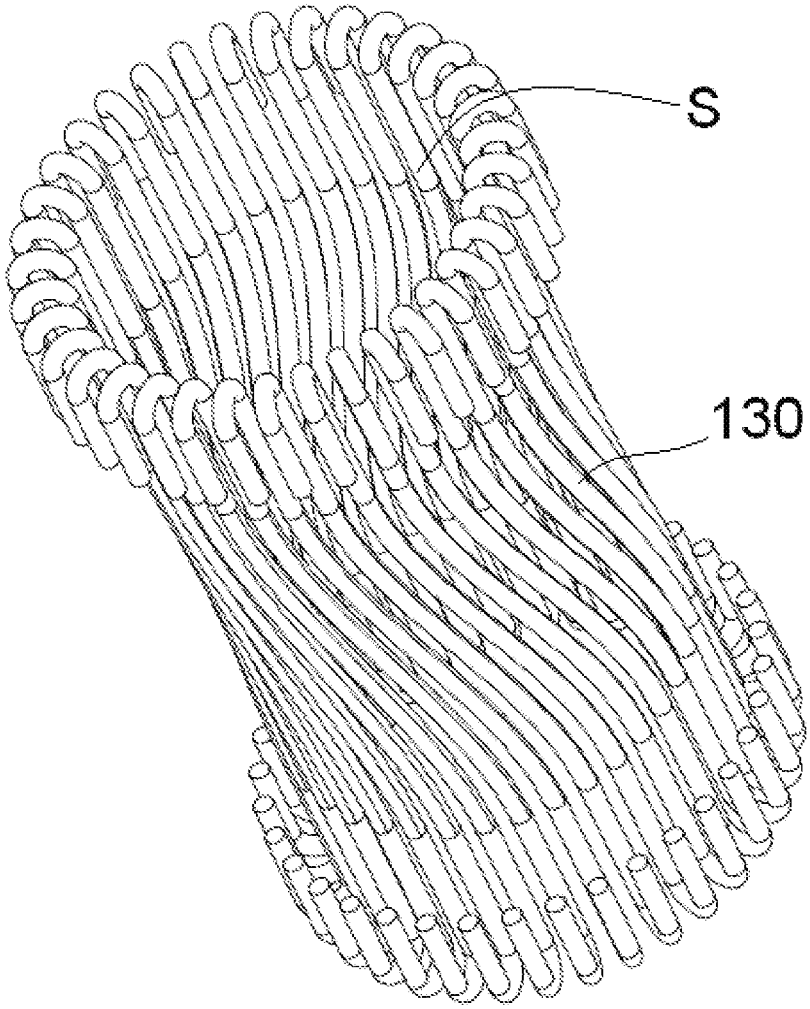
FIG. 10 is a perspective view of the elongated conductors in a rotated state in which the elongated conductors are twisted and deformed.
Figure 11:
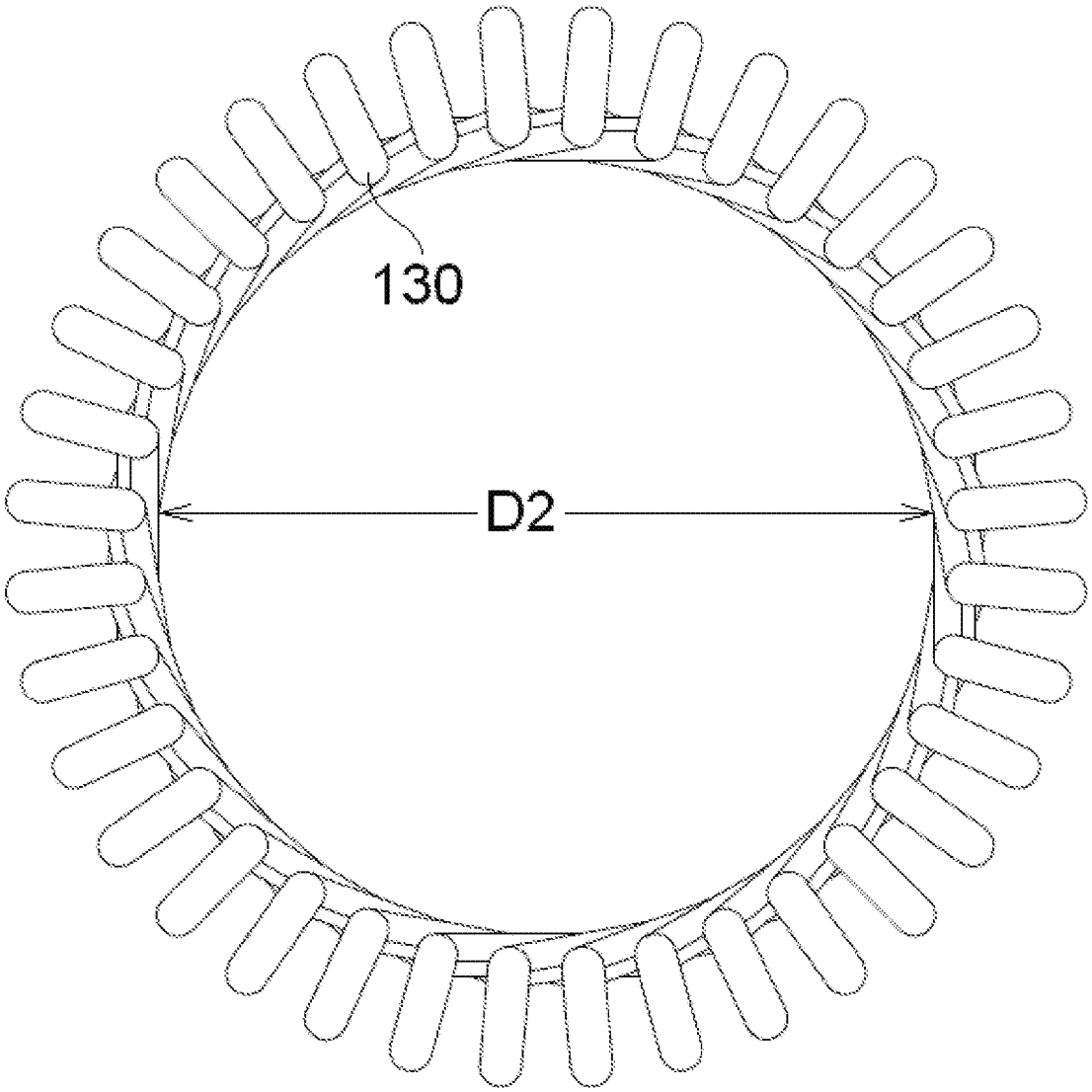
FIG. 11 is a plan view of the elongated conductors in the rotated state.

As shown in FIGS. 1-5 and 8, in an embodiment, the plurality of elongated conductors 130 are arranged around a circumference in a circular shape and spaced apart from each other at a regular interval. An inner space S into which a plug 200 is to be inserted, shown in FIG. 8, is defined among the elongated conductors 130. As shown in FIGS. 8-9, in an embodiment, the elongated conductors 130 are arranged around the circumference by a uniform interval.

Figure 6:
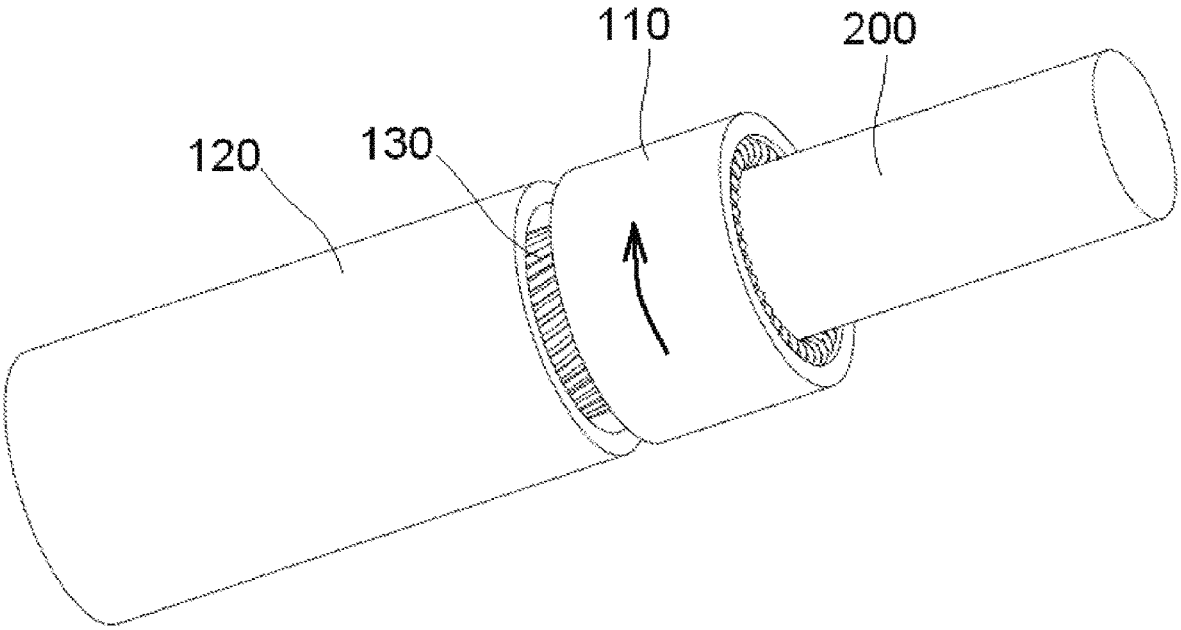
FIG. 6 is a perspective view of rotating a first cylinder of the receptacle connector with respect to a second cylinder of the receptacle connector.
Figure 7:
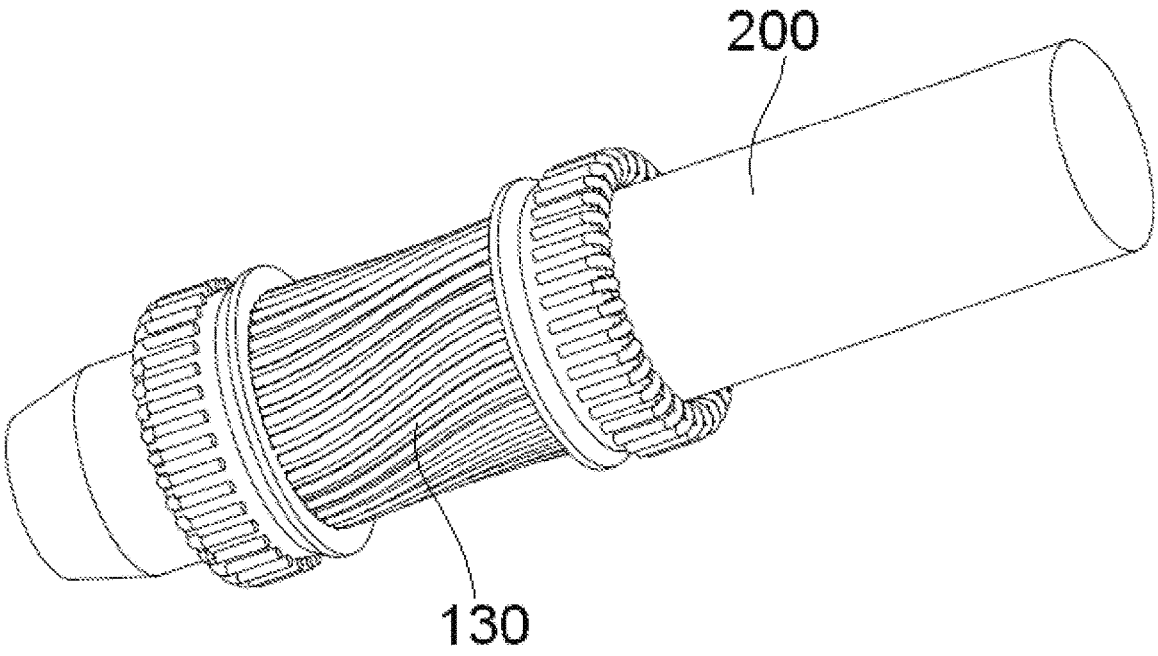
FIG. 7 is a perspective view of the plurality of elongated conductors of the receptacle connector twisted and deformed by the rotation of the first cylinder relative to the second cylinder.

As shown in FIGS. 6-7, in an embodiment, the first cylinder 110 is rotatable relative to the second cylinder 120 by a predetermined angle, and the elongated conductors 130 are twisted and deformed by rotating the first cylinder 110 relative to the second cylinder 120. When twisted and deformed, the elongated conductors 130 clasp the plug 200 inserted into the inner space S and electrically contact the plug 200.

As shown in FIGS. 2-5 and 8-9, in an embodiment, an inner diameter D1 of the inner space S is slightly larger than an outer diameter of the plug 200 when the elongated conductors 130 are not twisted and deformed. The plug 200 is inserted into or pulled out of the inner space S when the elongated conductors 130 are not twisted and deformed, so that a force to insert or pull out the plug 200 is minimized, for example, equal to zero.

As shown in FIGS. 6-7 and 10-11, in an embodiment, the inner diameter D2 of the inner space S is slightly less than the outer diameter of the plug 200 when the elongated conductors 130 are twisted and deformed, so that the twisted and deformed elongated conductors 130 tightly clasp the plug 200 and electrically contact the plug 200.

As shown in FIG. 1, in an embodiment, the first cylinder 110 and the second cylinder 120 have a same inner diameter. In an embodiment, the first cylinder 110 and the second cylinder 120 have a common center axis. In an embodiment, at least one of the first cylinder 110 and the second cylinder 120 is a conductive metal cylinder and, in another embodiment, at least one of the first cylinder 110 and the second cylinder 120 is an electrically insulative cylinder. In another embodiment, one of the first cylinder 110 and the second cylinder 120 is a conductive metal cylinder, and the other of the first cylinder 110 and the second cylinder 120 is an electrically insulative cylinder.

The receptacle connector, in an embodiment, includes an insulation base. The second cylinder 120 is fixed on the insulation base.

Figure 3:
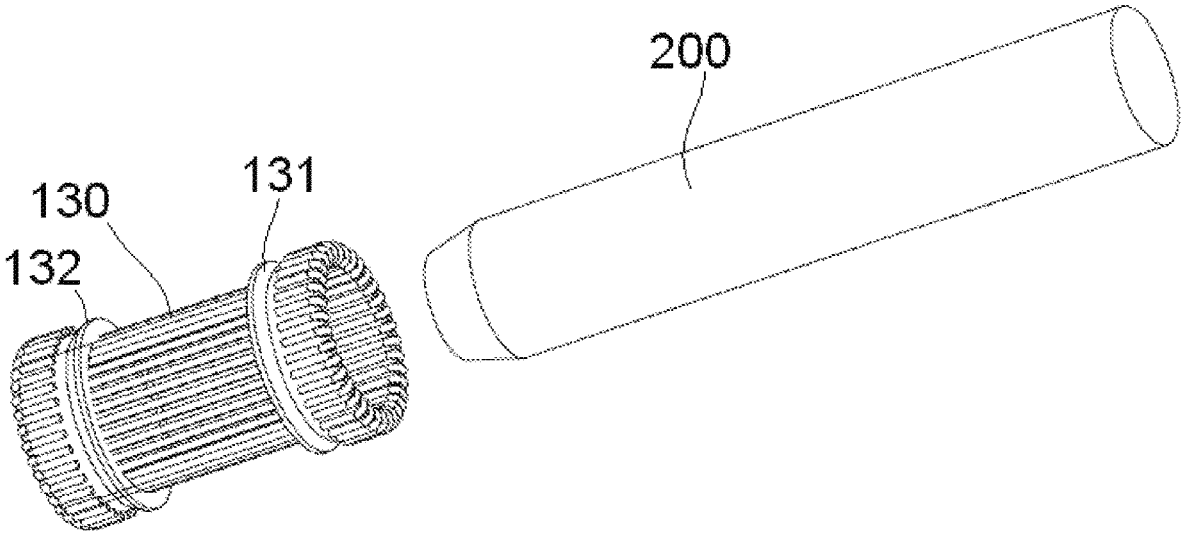
FIG. 3 is a perspective view of a plurality of elongated conductors of the receptacle connector and the plug connector.
Figure 4:
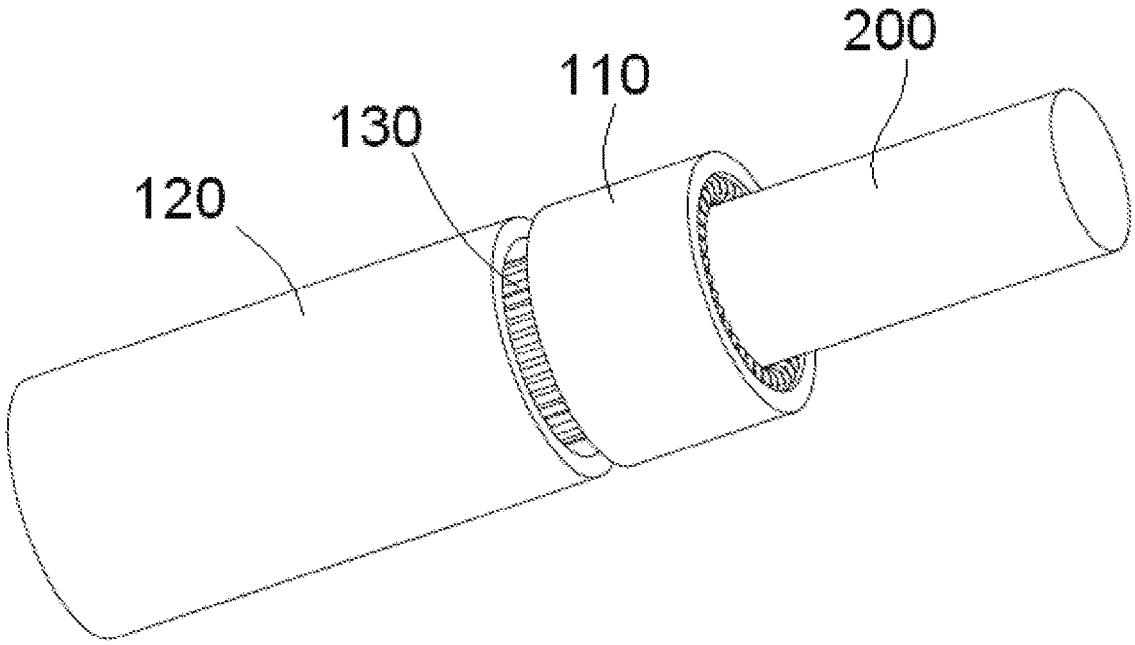
FIG. 4 is a perspective view of the plug connector inserted into the receptacle connector.
Figure 5:
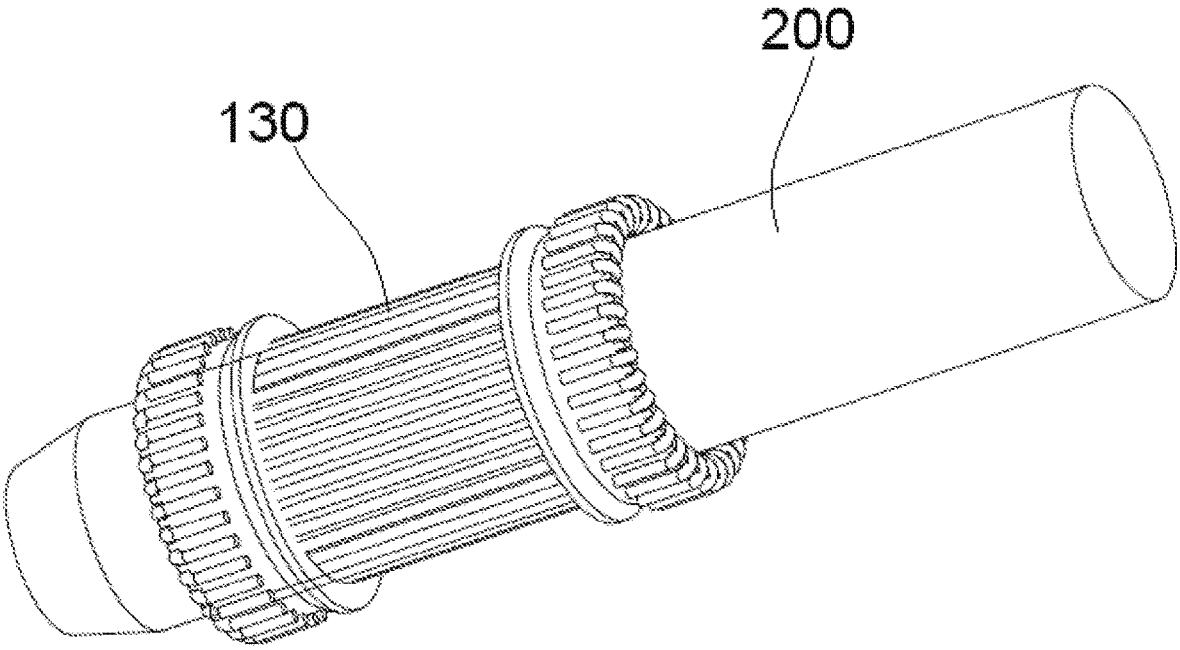
FIG. 5 is a perspective view of the plug connector inserted into the plurality of elongated conductors of the receptacle connector.

As shown in the embodiment of FIG. 3, the receptacle connector includes a first flange 131 and a second flange 132. The first ends of the plurality of elongated conductors 130 are connected to the first flange 131. The second ends of the plurality of elongated conductors 130 are connected to the second flange 132. The first flange 131 is connected to an inner wall of the first cylinder 110. The second flange 132 is connected to an inner wall of the second cylinder 120; the first ends of the plurality of elongated conductors 130 are connected to the first cylinder 110, and the second ends are connected to the second cylinder 120.

A method of inserting a plug of a plug connector into the receptacle connector will now be described in greater detail with reference to FIGS. 1-11. The method includes the steps of:

S110: as shown in FIGS. 1-5 and 8-9, inserting the plug 200 of the plug connector into the inner space S defined by the elongated conductors 130 of the receptacle connector 100 when the elongated conductors 130 are in an initial state where the elongated conductors 130 are not twisted and deformed; and S120: as shown in FIGS. 6-7 and 10-11, rotating the first cylinder 110 of the receptacle connector 100, so that the elongated conductors 130 are moved to a rotated state in which the elongated conductors 130 are twisted and deformed to clasp the plug 200 inserted into the inner space S and electrically contact the plug 200.

A method of pulling a plug of a plug connector out of the receptacle connector includes the steps of:

S210: rotating the first cylinder 110 of the receptacle connector 100, so that the elongated conductors 130 are restored to the initial state where the elongated conductors 130 are not twisted and deformed; and S220: pulling the plug 200 of the plug connector out of the receptacle connector 100.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A receptacle connector, comprising:

a first cylinder;

a second cylinder, the first cylinder is rotatable relative to the second cylinder; and a plurality of elongated conductors, each of the elongated conductors has a first end located in and connected to the first cylinder and a second end located in and connected to the second cylinder, the elongated conductors are arranged in a circular shape and are spaced apart from each other, the elongated conductors define an inner space into which a plug is inserted, the elongated conductors clasp and electrically contact the plug in the inner space when the elongated conductors are twisted and deformed by rotation of the first cylinder relative to the second cylinder.

2. The receptacle connector of claim 1, wherein an inner diameter of the inner space is larger than an outer diameter of the plug when the elongated conductors are in an initial state in which the elongated conductors are not twisted and deformed.

3. The receptacle connector of claim 2, wherein the plug is inserted into or pulled out of the inner space when the elongated conductors are in the initial state.

4. The receptacle connector of claim 3, wherein the inner diameter of the inner space is less than the outer diameter of the plug when the elongated conductors are in a rotated state in which the elongated conductors are twisted and deformed.

5. The receptacle connector of claim 1, wherein the elongated conductors are arranged circumferentially around the circular shape at a uniform interval.

6. The receptacle connector of claim 1, wherein the first cylinder and the second cylinder have a same inner diameter.

7. The receptacle connector of claim 1, wherein the first cylinder and the second cylinder have a common center axis.

8. The receptacle connector of claim 1, wherein at least one of the first cylinder and the second cylinder is a conductive metal cylinder.

9. The receptacle connector of claim 1, wherein at least one of the first cylinder and the second cylinder is an electrically insulative cylinder.

10. The receptacle connector of claim 1, wherein one of the first cylinder and the second cylinder is a conductive metal cylinder and the other of the first cylinder and the second cylinder is an electrically insulative cylinder.

11. The receptacle connector of claim 1, further comprising an insulation base on which the second cylinder is fixed.

12. The receptacle connector of claim 1, further comprising a first flange to which the first end of each of the elongated conductors is connected.

13. The receptacle connector of claim 12, further comprising a second flange to which the second end of each of the elongated conductors is connected.

14. The receptacle connector of claim 13, wherein the first flange is connected to an inner wall of the first cylinder and the second flange is connected to an inner wall of the second cylinder.

15. A method of inserting a plug into a receptacle connector, comprising:

providing the receptacle connector including a first cylinder, a second cylinder, and a plurality of elongated conductors, each of the elongated conductors has a first end located in and connected to the first cylinder and a second end located in and connected to the second cylinder, the elongated conductors are arranged in a circular shape and are spaced apart from each other, the first cylinder is rotatable relative to the second cylinder;

inserting the plug into an inner space defined by the elongated conductors with the elongated conductors in an initial state in which the elongated conductors are not twisted and deformed; and rotating the first cylinder relative to the second cylinder to move the elongated conductors into a rotated state in which the elongated conductors are twisted and deformed and clasp and electrically contact the plug in the inner space.

16. A method of removing a plug from a receptacle connector, comprising:

providing the receptacle connector including a first cylinder, a second cylinder, and a plurality of elongated conductors, each of the elongated conductors has a first end located in and connected to the first cylinder and a second end located in and connected to the second cylinder, the elongated conductors are arranged in a circular shape and are spaced apart from each other, the first cylinder is rotatable relative to the second cylinder;

rotating the first cylinder relative to the second cylinder to move the elongated conductors from a rotated state in which the elongated conductors are twisted and deformed and clasp the plug in the inner space to an initial state in which the elongated conductors are not twisted and deformed; and pulling the plug out of the receptacle connector.

17. A receptacle connector, comprising:

a first cylinder;

a second cylinder rotatable relative to the first cylinder;

a plurality of discrete elongated conductors, each of the elongated conductors having a first free end connected to a first flange, and a second free end connected to a second flange, the first and second flanges separated by the plurality of discrete conductors and connected to and arranged within a respective one of the first and second cylinders, the elongated conductors arranged in a circular shape and spaced apart from each other to define an inner space into which a plug is inserted, the elongated conductors clasp and electrically contact the plug in the inner space when the elongated conductors are twisted and deformed by rotation of the first cylinder and the first flange relative to the second cylinder and the second flange.

18. The receptacle connector of claim 17, wherein the first flange is connected to an inner wall of the first cylinder and the second flange is connected to an inner wall of the second cylinder.

19. The receptacle connector of claim 17, further comprising an insulation base on which the second cylinder is fixed.

20. The receptacle connector of claim 17, wherein at least one of the first cylinder or the second cylinder is an electrically insulative cylinder.

* * * * *